US006439191B1

(12) United States Patent
Elliott

(10) Patent No.: US 6,439,191 B1
(45) Date of Patent: Aug. 27, 2002

(54) FUEL RAM-INJECTOR AND IGNITER IMPROVEMENTS

(76) Inventor: George D. Elliott, 14902 Clovercrest Dr., SE., Huntsville, AL (US) 35803

( * ) Notice: Subject to any disclaimer, the term of this patent is extended or adjusted under 35 U.S.C. 154(b) by 40 days.

(21) Appl. No.: 09/710,634

(22) Filed: Nov. 9, 2000

Related U.S. Application Data

(60) Provisional application No. 60/165,053, filed on Nov. 12, 1999.

(51) Int. Cl.[7] ..... F02M 39/00; F02M 57/06

(52) U.S. Cl. ..... 123/297; 123/485; 123/504; 123/145 R

(58) Field of Search ..... 123/297, 298, 123/446, 455, 496, 485, 503, 504, 145 A, 145 R, 143 R

(56) References Cited

U.S. PATENT DOCUMENTS 4,048,971 A * 9/1977 Pritchett ..... 123/507
4,469,059 A 9/1984 Hukill
4,603,667 A 8/1986 Grünwald et al.
4,787,349 A 11/1988 Hilger
4,834,043 A 5/1989 Kaczynski et al.
4,926,819 A 5/1990 Auwürter
4,955,340 A * 9/1990 Elliott ..... 123/297
5,063,898 A 11/1991 Elliott
6,289,869 B1 * 9/2001 Elliott ..... 123/145 R

* cited by examiner

*Primary Examiner*—John Kwon
*Assistant Examiner*—Hieu T. Vo
(74) *Attorney, Agent, or Firm*—Alston & Bird LLP

(57) ABSTRACT

An electromagnetic fuel ram-injector and improved igniter apparatus, comprising a fuel injector, and a fuel igniter in series with the injector, to ignite fuel passing through the injector.

20 Claims, 7 Drawing Sheets

FUEL RAM-INJECTOR AND IGNITER IMPROVEMENTS

CROSS REFERENCE TO RELATED APPLICATIONS

This application incorporates by reference the contents of pending patent application 09/152,142, filed Sep. 11, 1998, now U.S. Pat. No. 6,289,869 issued Sep. 18, 2001, and claims the benefit of U.S. Provisional Application No. 60/165,053, filed Nov. 12, 1999.

TECHNICAL FIELD

The present invention generally relates to combustion systems, and particularly relates to an electromagnetic fuel ram-injector and improved igniter.

BACKGROUND OF THE INVENTION

Electromagnetic fuel ram-injector and improved igniters are known in the art.

Igniters which contain a wire wound heater element in the venturi throat. This configuration exposes the heater wires to the high velocity stream of fuel during injection/ignition.

This action causes these wires to deteriorate over time, resulting in an open circuit.

Therefore, improvements are needed.

SUMMARY OF THE INVENTION

The present invention overcomes deficiencies in the prior art by providing an improved electromagnetic fuel ram-injector and igniter.

Generally described, the present invention relates to an electromagnetic fuel ram-injector and improved igniter apparatus, comprising a fuel injector, and a fuel igniter in series with the injector, to ignite fuel passing through the injector.

More particularly described, the present invention includes the use of in igniter which includes an internal bore with in internal ignition wire.

More particularly described, the present invention includes the use of in igniter which includes one or more internal bores with an external ignition wire.

Therefore it is an object of the present invention to provide an improved electromagnetic fuel ram-injector and improved igniter.

It is a further object of the present invention to provide an improved electromagnetic fuel ram-injector.

It is a further object of the present invention to provide an improved igniter.

It is a further object of the present invention to provide an improved electromagnetic fuel ram-injector and improved igniter which can be used with a variety of fuels.

It is a further object of the present invention to provide an improved electromagnetic fuel ram-injector and improved igniter which has long lasting performance features.

It is a further object of the present invention to provide an improved electromagnetic fuel ram-injector and improved igniter which bums efficiently.

Other objects, features, and advantages of the present invention will become apparent upon reading the following detailed description of the preferred embodiment of the invention when taken in conjunction with the drawing and the appended claims.

BRIEF DESCRIPTION OF THE DRAWINGS

FIG. 3 is an electrical schematic according to the present invention, of a circuit which energizes the upper and lower coils of the ram, (causing up and down movement of the ram pump), while likewise energizing the heater element of the igniter.

DETAILED DESCRIPTION OF THE PREFERRED EMBODIMENT

The present invention generally relates to combustion engines, and particularly relates to a direct fuel injection system.

This direct injection invention delays the fuel injection, in an internal combustion engine, until time for ignition, and then ignites the fuel as it is being injected. With an unthrottled air intake this condition creates a modified cycle engine which, because of its hot-throated igniter, permits the use of any of the presently used or considered for use fuels. The proximity of the unit's igniter to the injector allows an extremely lean fuel/air operation, producing an efficient clean burning engine.

The use of this device creates a modified cycle internal combustion engine. No spark is needed, nor is a very high compression ratio needed such as in the case of diesel systems.

The air is not throttled such as in the case of a typical gasoline engine; the power output is regulated by the fuel injected.

The Igniter

Some igniters which contain a wire wound heater element exposed in the venturi throat. This configuration exposes the heater wires to the high velocity stream of fuel during injection/ignition. This action causes these wires to deteriorate over time, resulting in an open circuit.

In contrast, this invention will provide the heater element with a hard, very high temperature, tubular ceramic shield to protect the element.

This shield is cast as a ceramic tube 50 having a smooth inner venturi throat. The outer wall of this tube a central ceramic tube 50 contains a cast helically spiraled groove. This groove forms a channel for positioning the electrical heater element. This element is either resistance wire or a plasma deposited metal alloy. The element is then given a protective ceramic overcoat. This overall element can be attached to the heater element 20.

The igniter element is completed by placing a notched ring 60 a one end of the tube and a ported metal mixing chamber at the opposite end. These end units are electrically bonded to the combustion-side end of winding to form the electrical circuit for applying the heating voltage.

The notches in the bottom ring 60 form an entry passage to the space between the outside wall of the heater element and the inner wall of the unit assembly casing, thus forming an air channel leading to the ported mixing chamber 70 at the opposite end.

Figure 1:
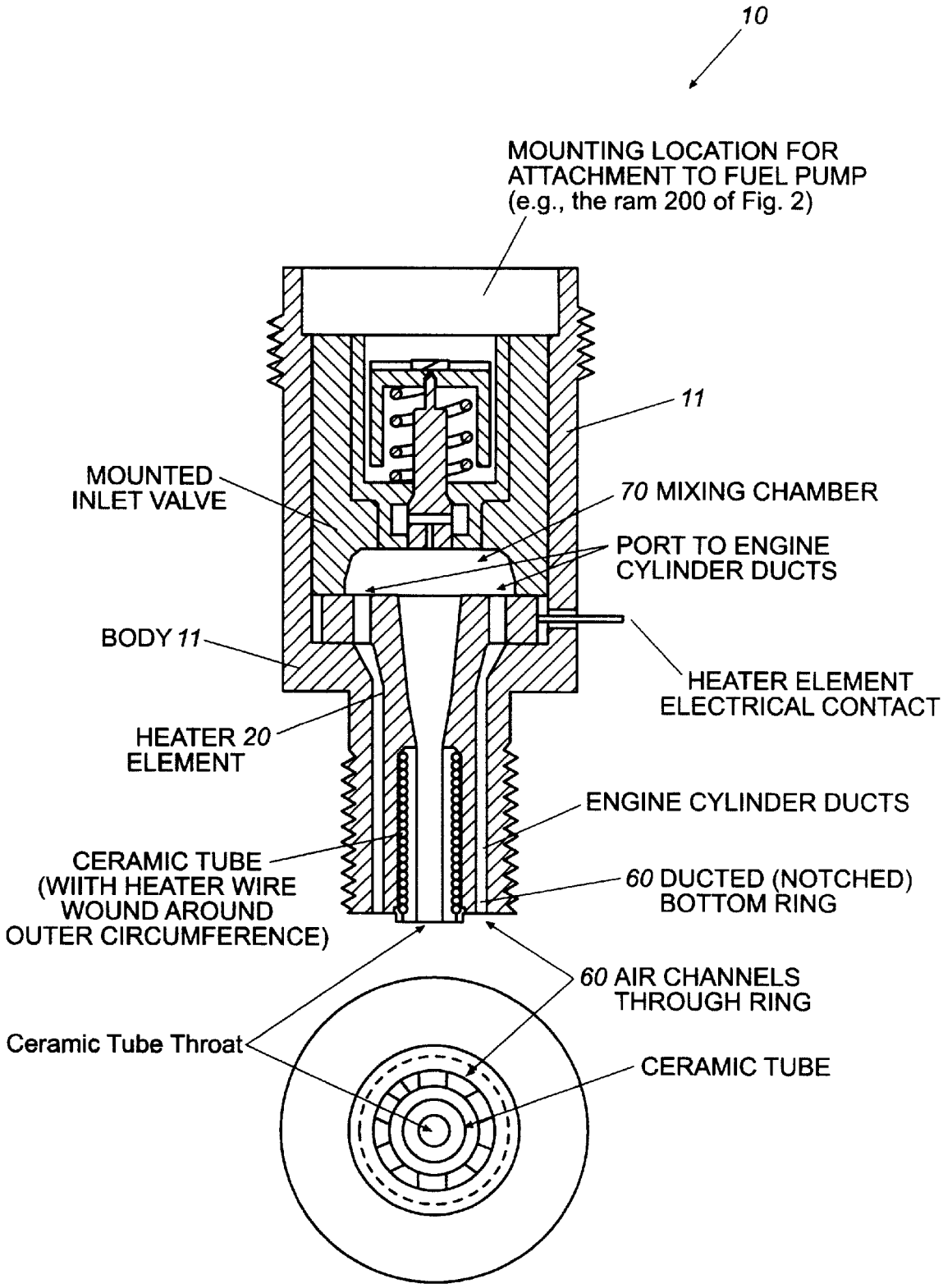
FIG. 1 is a cross-sectional view illustrating an igniter unit 10 according to the present invention.
Figure 2:
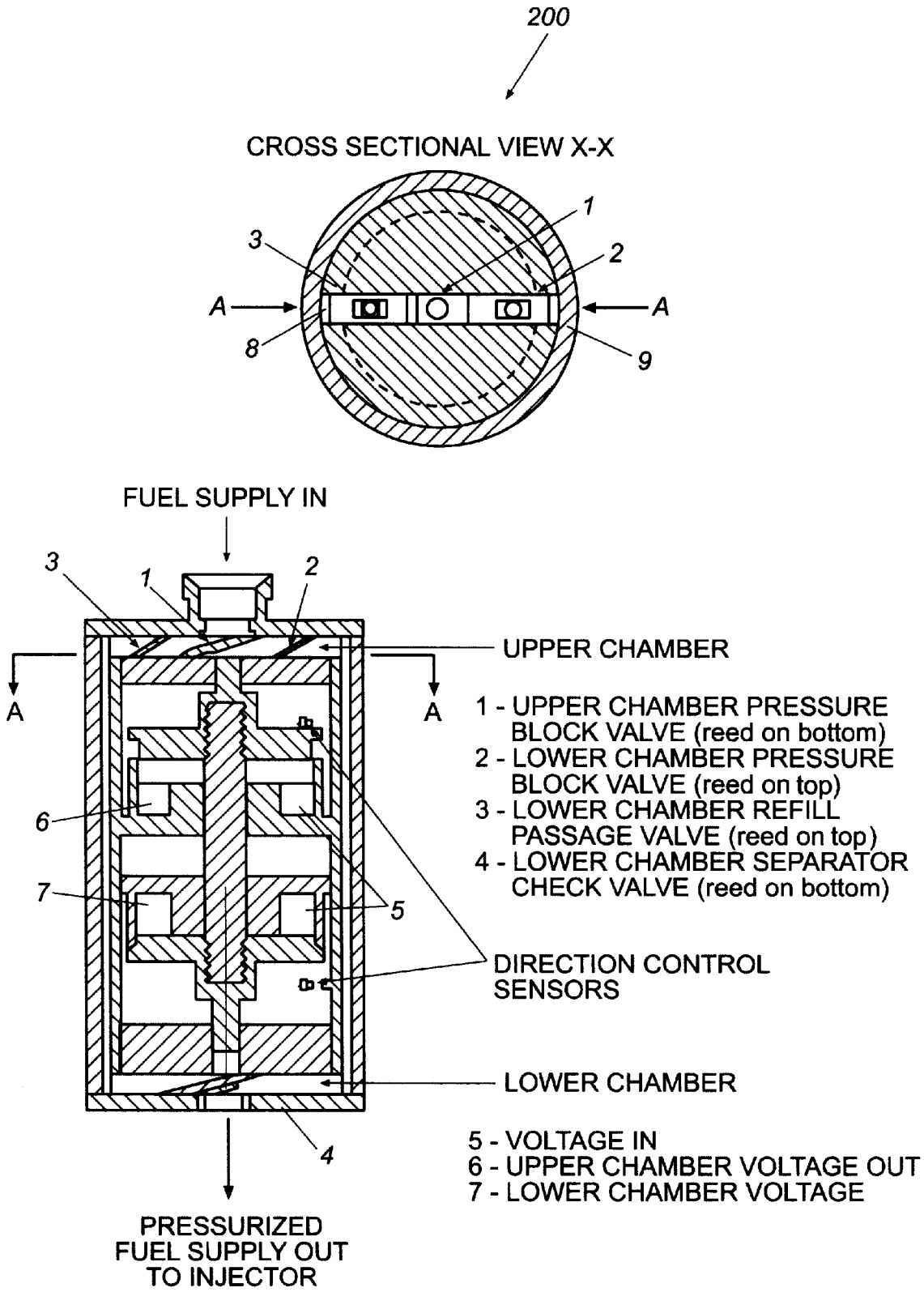
FIG. 2 is a longitudinal cross-sectional view and a transverse cross-sectional view, combining to illustrate an electromagnetic ram assembly 200 according to the present invention.
Figure 7:
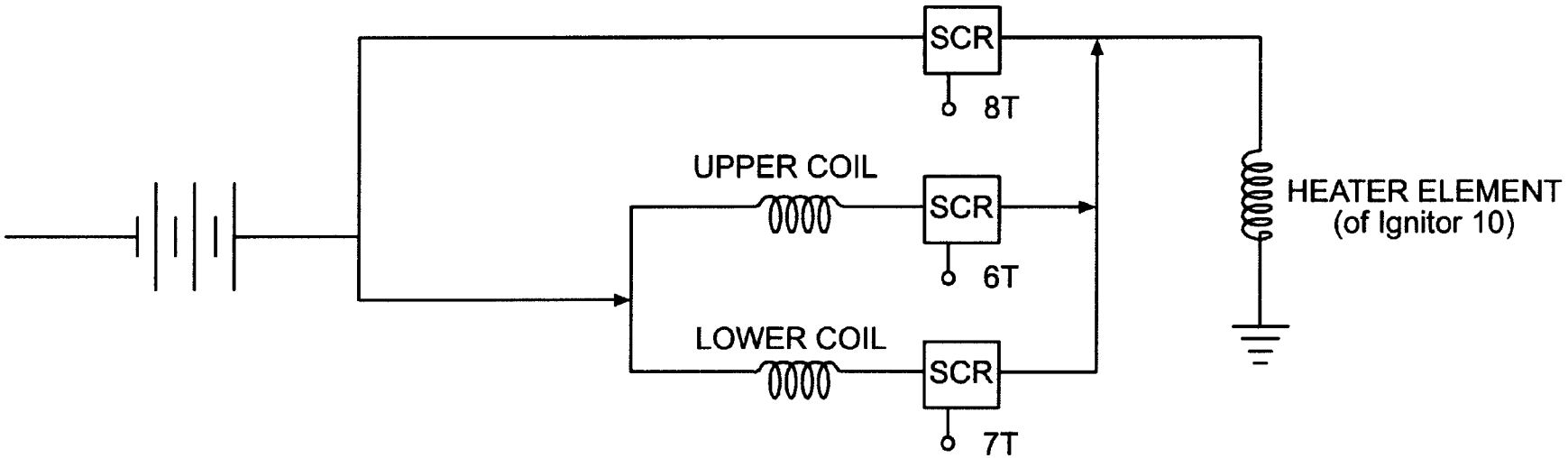
FIG. 7 illustrates an assembled view of that shown in FIG. 6, which may not exactly be the invention but is used for reference purposes.
Figure 4:
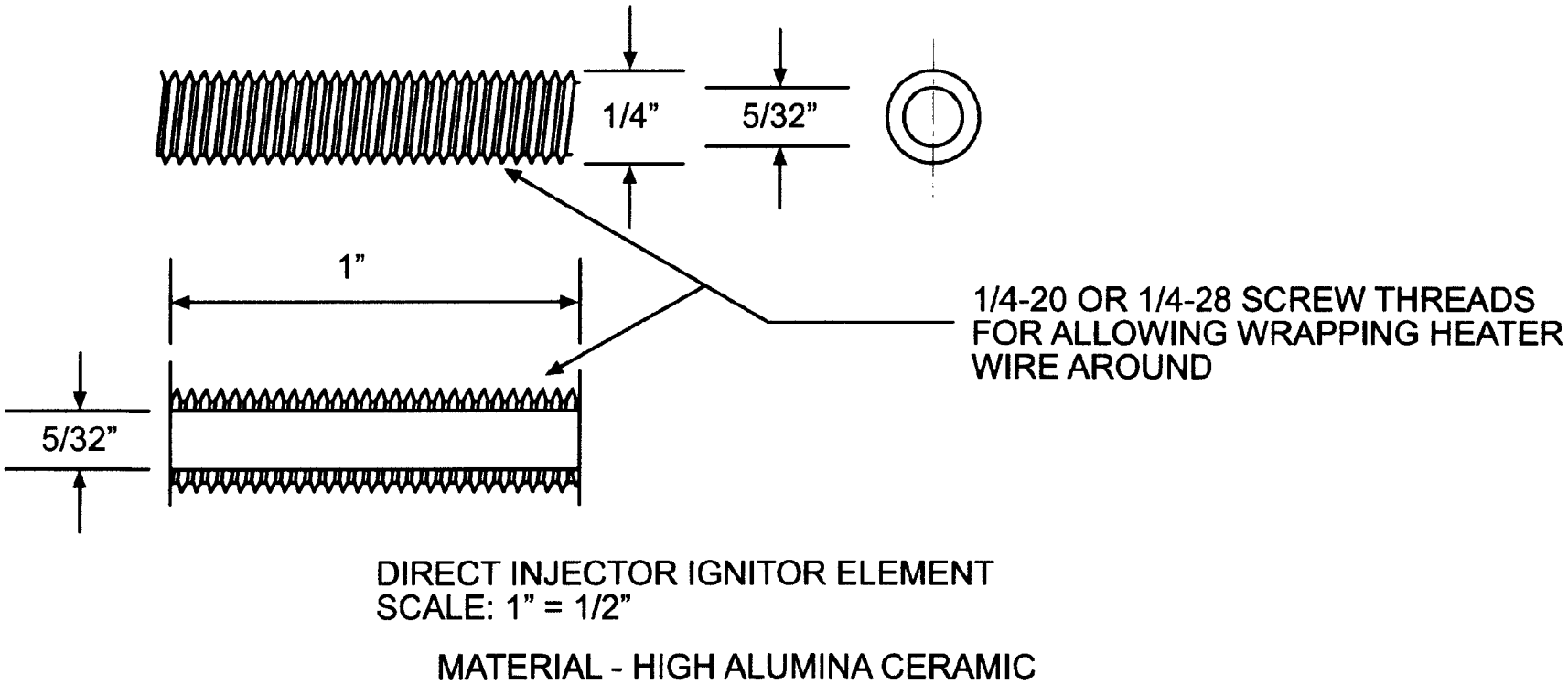
FIG. 4 includes several views of an isolated central ceramic tube 50 according to the present invention.
Figure 5:
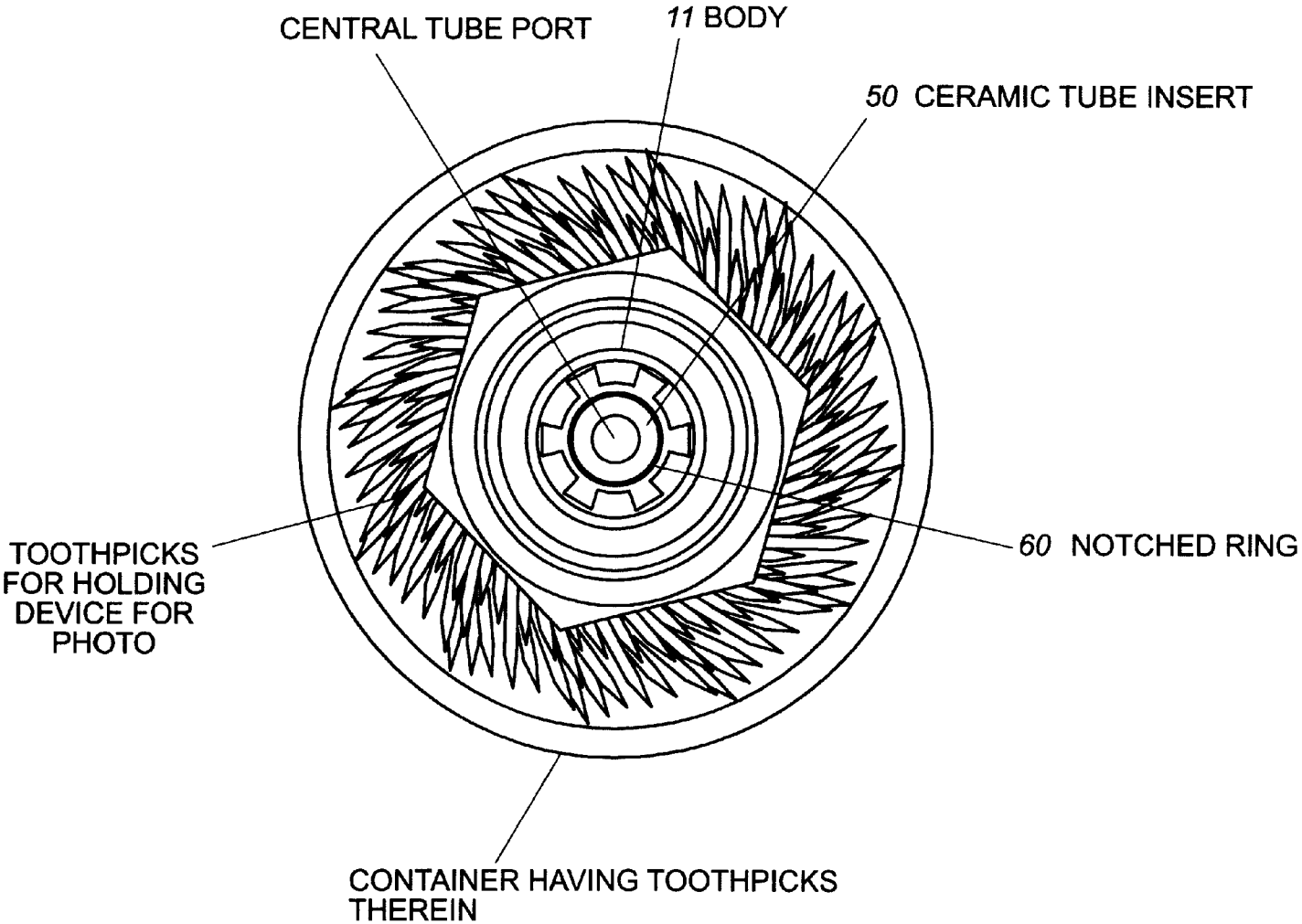
FIG. 5 is a "combustion chamber-eye view", which illustrates what the combustion chamber sees of the igniter unit 10. The unit is shown for viewing purposes only as being positioned within a cup filled with toothpicks. As may be seen, there is shown a central ceramic tube 50, and a slotted end disk 60. The slotted end disk 60 provides an electrical connection between the body 11 and one end of the heating coil, which extends around the outside of the tubular central ceramic tube 20.
Figure 6:
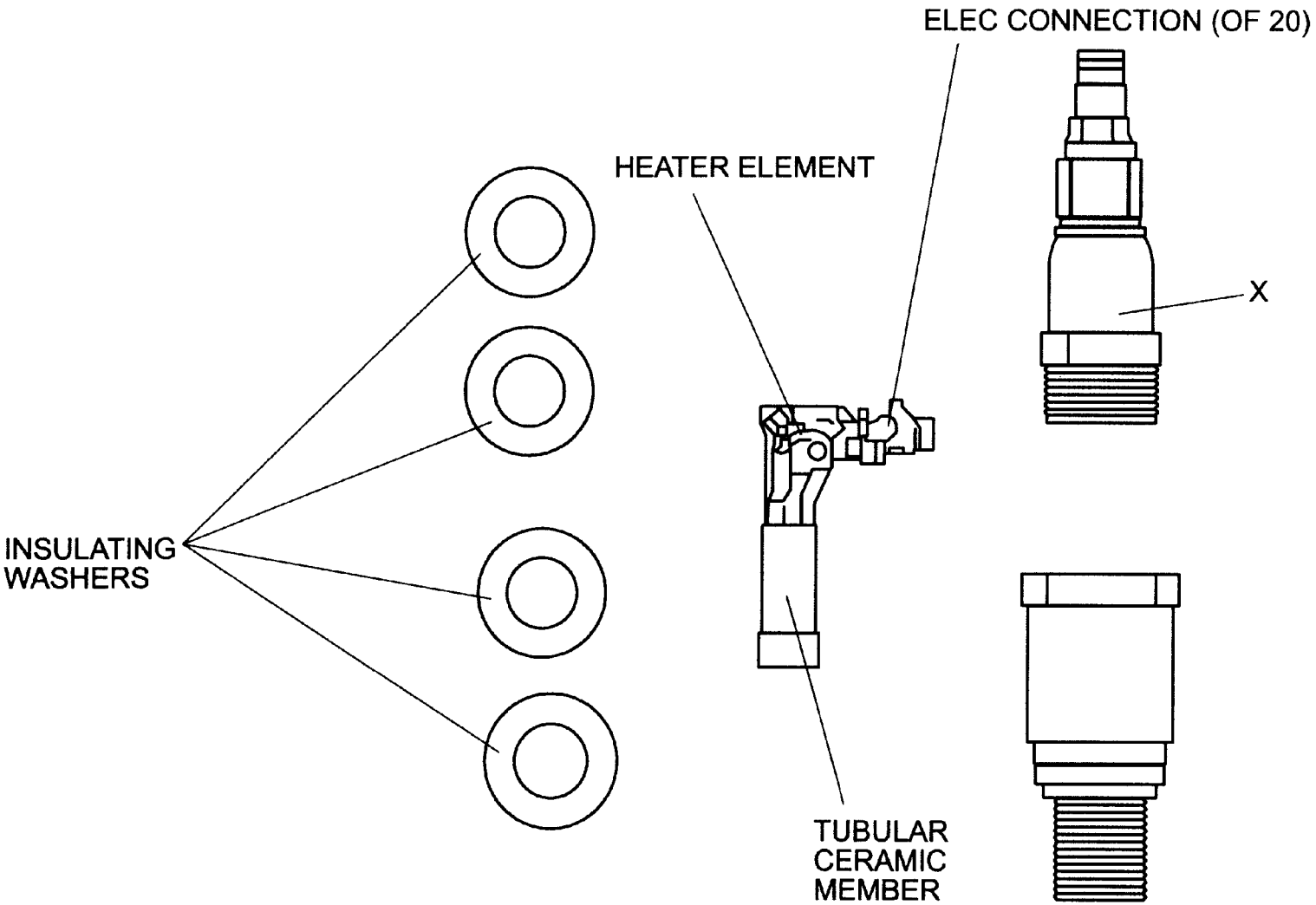
FIG. 6 illustrates various individual elements of an assembly which includes an igniter unit 10 used with a conventional pump. It should be understood that the body "X" shown in this figure may not be the same as used in the intended invention.
Figure 7:
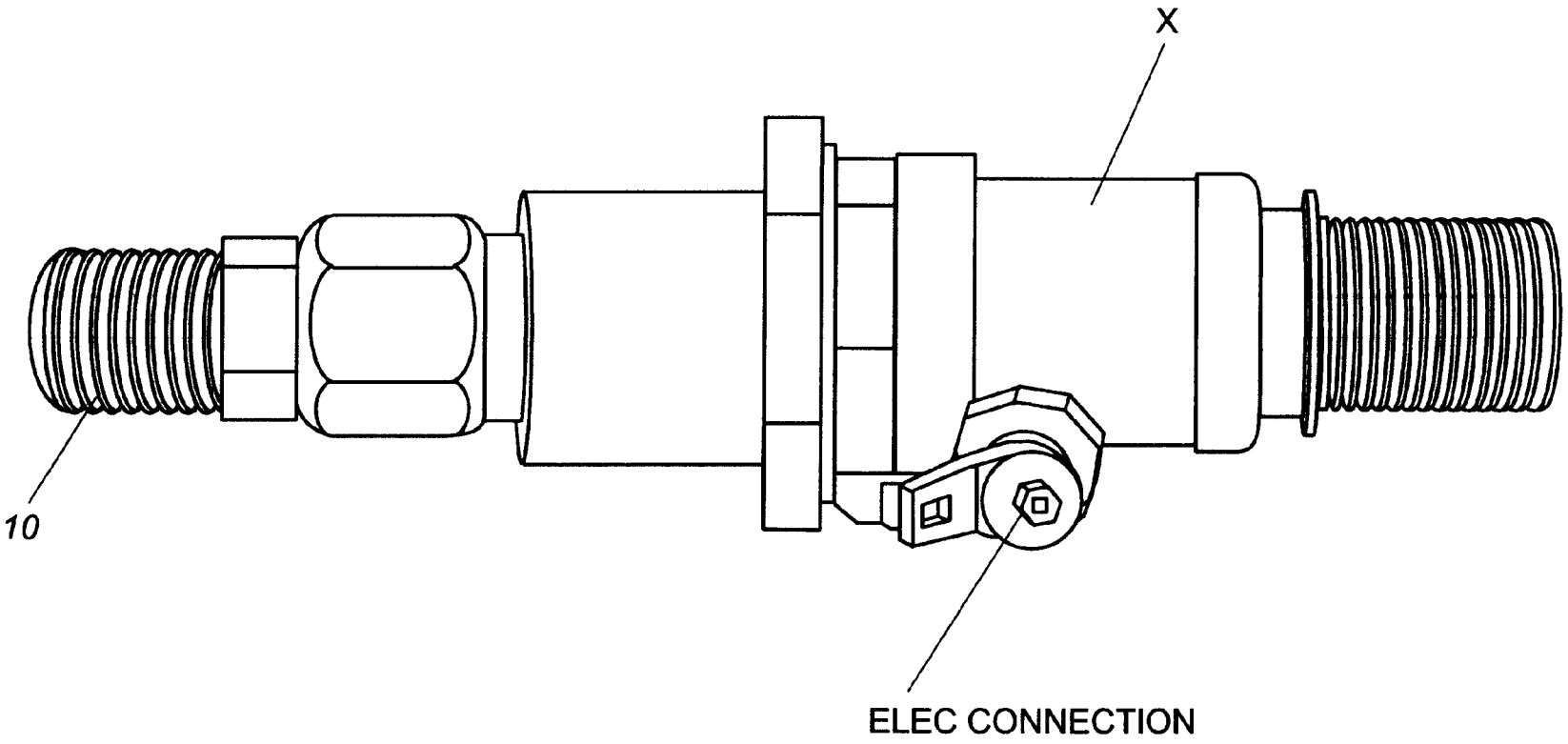

The Fuel Ram (FIG. 2)

The fuel ram assembly 200 produces a force, depending upon the windings; needed to produce the fuel pressure required for a particular engine.

This force applied to the cross sectional area of the ram results in injection pressures which can excess of 1500 psi.

Ram injection is done in both stroke directions of the ram. Refill is accomplished on one end of the ram while the other end is injecting. Therefore no return time is required for refill. This is done be the use of the check valves as discussed below.

The volume of the ram fuel cavity is sufficient to support maximum engine power per stroke. During idle and other lower power operation only a portion of the stroke is utilized for each injection, therefore several injections can be made from one end before switching is required.

The electronic controller supplies the pulse train, determined by the throttle position, to the magnetic attractor in use. This train of injection will recur until the inoperative magnet disk contacts its associated direction control sensor. The electronic controller will then switch the operating voltage to the opposite magnet and inject from the other end of the ram. This sequence of operation repeats as required.

The check valves cause flow to go out the outlet port no matter what stroke direction. For example, during down stroking, flow goes through valves 1 and 4, with valves 2 and 3 blocking reverse flow. During upstroke, flow through valves 1 and 4 is blocked, with valves 2 and 3 allowing flow. Side flow channels are provided along the side of the apparatus to allow for fluid communication between the upper and the lower chamber.

Assembly

The assembled heater/igniter unit can be fitted into the casing which supports the injector and fuel ram, discussed below. This assembled unit is inserted into the engine cylinder where, in other engines, the sparkplug or, in diesel engines, the fuel injector is located.

Additional Improvement

An additional improvement facilitated by this invention is the impregnation of the ceramic sleeve with powdered metal (platinum, rhodium, iridium etc.) to aid in the catalysis of the fuel/air mixture as it passes through the hot throat.

Conclusion

While this invention has been described in specific detail with reference to the disclosed embodiments, it will be understood that many variations and modifications may be effected within the spirit and scope of the invention as described in the appended claims.

What is claimed is:

1. A fuel ram assembly for providing fuel to a combustion engine, said fuel ram assembly comprising:

a body defining an internal chamber and an inlet and an outlet port;

a ram configured for back-and-forth movement within a portion of said internal chamber; and a plurality of valves and defined passageways within said internal chamber, said valves and passageways configured such that fuel flow exits said outlet port during said back movement of said ram and also exits during said forth movement of said ram, such that flow is directed from said outlet port of said fuel ram assembly no matter what the stroke direction of the ram.

2. The fuel ram assembly as claimed in claim 1, further comprising the use of direction control sensors which can be used to reverse the stroke of said ram.

3. The fuel ram assembly as claimed in claim 2, wherein said stroke of said ram and the configuration of said internal chamber is configured such that maximum engine power is supported per stroke.

4. The fuel ram assembly as claimed in claim 2, wherein said stroke of said ram and the configuration of said internal chamber is configured such that maximum engine power is supported per stroke.

5. The fuel ram assembly as claimed in claim 1, wherein said stroke of said ram and the configuration of said internal chamber is configured such that maximum engine power is supported per stroke.

6. The fuel ram assembly as claimed in claim 1, wherein said valves comprise one-way reed valves.

7. The fuel ram assembly as claimed in claim 1, further comprising the use of direction control sensors which can be used to reverse the stroke of said ram.

8. The fuel ram assembly as claimed in claim 1, wherein said stroke of said ram and the configuration of said internal chamber is configured such that maximum engine power is supported per stroke.

9. The fuel ram assembly as claimed in claim 1, wherein said valves comprise one-way reed valves.

10. A fuel ram assembly for providing fuel to a combustion engine, said fuel ram assembly comprising:

a body defining an internal chamber including an upper chamber portion, a lower chamber portion, side channels connecting said upper and lower chamber portions, and an inlet and an outlet port;

a ram configured for back-and-forth movement within a portion of said internal chamber; and a plurality of valves within said internal chamber, said valves and passageways configured such that fuel flow exits said outlet port from said lower chamber during said back movement of said ram and also exits during said forth movement of said ram, such that flow is directed from said outlet port of said fuel ram assembly no matter what the stroke direction of the ram.

11. The fuel ram assembly as claimed in claim 10, further comprising the use of direction control sensors which can be used to reverse the stroke of said ram.

12. The fuel ram assembly as claimed in claim 11, wherein said stroke of said ram and the configuration of said internal chamber is configured such that maximum engine power is supported per stroke.

13. The fuel ram assembly as claimed in claim 10, wherein said stroke of said ram and the configuration of said internal chamber is configured such that maximum engine power is supported per stroke.

14. The fuel ram assembly as claimed in claim 10, wherein said valves comprise one-way reed valves.

15. A fuel ram assembly for providing fuel to a combustion engine, said fuel ram assembly comprising:

a body defining an internal chamber including an upper chamber portion, a lower chamber portion, side channels connecting said upper and lower chamber portions, and an inlet and an outlet port;

a ram configured for back-and-forth movement within a portion of said internal chamber;

a plurality of valves within said internal chamber, said valves and passageways configured such that fuel flow exits said outlet port from said lower chamber during said back movement of said ram and also exits during said forth movement of said ram; and ram controlling circuitry which allows for control of said ram such that said ram may be stroked less during an idle mode or may be stroked more during a higher power need, such that flow is directed from said outlet port of said fuel ram assembly no matter what the stroke direction of the ram.

16. A fuel ram assembly for providing fuel to a combustion engine, said fuel ram assembly comprising:

a body defining an internal chamber and an inlet and an outlet port;

a ram configured for back-and-forth movement within a portion of said internal chamber;

a plurality of valves within said internal chamber, said valves and passageways configured such that fuel flow exits said outlet port from said lower chamber during said back movement of said ram and also exits during said forth movement of said ram; and ram controlling circuitry which allows for control of said ram such that said ram may be incrementally stroked less during an idle mode or may be stroked more during a higher power need, such that flow is directed from said outlet port of said fuel ram assembly no matter what the stroke direction of the ram.

17. The fuel ram assembly as claimed in claim 16, further comprising the use of direction control sensors which can be used to reverse the stroke of said ram.

18. The fuel ram assembly as claimed in claim 17, wherein said stroke of said ram and the configuration of said internal chamber is configured such that maximum engine power is supported per stroke.

19. The fuel ram assembly as claimed in claim 16, wherein said stroke of said ram and the configuration of said internal chamber is configured such that maximum engine power is supported per stroke.

20. The fuel ram assembly as claimed in claim 16, wherein said valves comprise one-way reed valves.

* * * * *